US006250546B1

(12) United States Patent
Karsten et al.

(10) Patent No.: US 6,250,546 B1
(45) Date of Patent: Jun. 26, 2001

(54) COMBINED STORAGE DISPLAY AND ORDERING MERCHANDISING UNIT

(75) Inventors: Richard A. Karsten, Forest Hills, NY (US); Kiat-Cheong Toh, Singapore (SG); Frederick B. Hadtke, New Providence, NJ (US); Inna Alesina, New York, NY (US); David W. Bradley, Chapel Hill, NC (US)

(73) Assignee: Eastman Kodak Company, Rochester, NY (US)

( * ) Notice: Subject to any disclaimer, the term of this patent is extended or adjusted under 35 U.S.C. 154(b) by 262 days.

(21) Appl. No.: 08/803,047

(22) Filed: Feb. 19, 1997

(51) Int. Cl.[7] ..... B65D 91/00

(52) U.S. Cl. ..... 232/43.1; 232/1 R; 232/44; 312/211

(58) Field of Search ..... 312/35, 211, 280, 312/281; 108/149, 152; 232/43.1, 43.3, 43.5, 44, 1 R; 222/173; 221/92, 102

(56) References Cited

U.S. PATENT DOCUMENTS

| | | | | |
|---|---|---|---|---|
| 760,278 | * | 5/1904 | Thurman | 312/281 X |
| 1,839,840 | * | 1/1932 | Fry | 312/35 |
| 2,188,586 | * | 1/1940 | Wirtz | 312/281 X |
| 3,012,704 | * | 12/1961 | Stumpf, Jr. | 312/35 |
| 3,028,206 | * | 4/1962 | Smith | 312/35 |
| 3,189,394 | * | 6/1965 | Fay | 312/281 X |
| 3,405,985 | * | 10/1968 | Higer | 312/211 X |
| 3,776,419 | * | 12/1973 | Zinkgraf et al. | 312/35 X |
| 3,897,855 | * | 8/1975 | Patterson | 312/280 X |
| 4,518,208 | * | 5/1985 | Marder | 312/281 X |
| 5,244,266 | * | 9/1993 | Maldanis | 312/116 |
| 5,427,036 | * | 6/1995 | Fee et al. | 312/211 X |
| 5,667,288 | * | 9/1997 | Kang | 312/211 |

* cited by examiner

*Primary Examiner*—Lynne H. Browne
*Assistant Examiner*—William L. Miller
(74) *Attorney, Agent, or Firm*—Frank Pincelli

(57) ABSTRACT

A combined photofinishing storage, display, and ordering merchandising unit. The unit includes an order workstation having a front wall, and a writing surface extending from the wall. A dispenser for dispensing order envelopes, and a collection bin for receiving filled order envelopes. A pair of display sections are provided for displaying of merchandise, one display section being placed on each side of the order workstation and positioned so as to define a storage area between the pair of display sections and workstation. At least one of the display sections is movable so as to allow access to the storage area. A display tower disposed adjacent the shelf which can be used for highlighting a featured product. One of the display sections may be movable for adjusting the width of the merchandising unit.

31 Claims, 13 Drawing Sheets

COMBINED STORAGE DISPLAY AND ORDERING MERCHANDISING UNIT

FIELD OF THE INVENTION

The present invention relates to merchandising units, and more particularly, to merchandising units for ordering of photofinishing services, displaying of associated photographic products, and storing of product inventory.

BACKGROUND OF THE INVENTION

Various different merchandising units are presently available for displaying of products and providing of services. Single use cameras and photographic films are typically sold by placing them in a merchandising display unit wherein customers can self-serve themselves by taking the desired number and type of products. It is also known to provide self-service units where customers can order photofinishing services. However, these two type self-serve units are separate and distinct units. Furthermore, prior art merchandising units do not typically take into consideration the storage of an inventory, or showcasing of products in a-secure manner.

The present invention provides a unique combined storage, display, and order merchandising unit. The unit includes a workstation whereby a customer can obtain an order envelope, fill out the order envelope, and drop off the envelope for ordering photofinishing services. Additionally, the merchandising unit includes display sections which are used for displaying of associated products. The various display sections and workstation are arranged such that a secure storage area is provided. Further, the display unit is designed to provide a degree of privacy when filling out orders for photofinishing services. A display case is provided which allows featuring of products in a relatively secure manner.

SUMMARY OF THE INVENTION

In accordance with one aspect of the present invention there is provided a combined photofinishing storage, display, and ordering merchandising unit, comprising:

an order workstation having a front wall, and a writing surface extending from the wall, a dispenser for dispensing order envelopes, and a collection bin for receiving filled order envelopes;

a pair of display sections for displaying of merchandise, one of said display sections being positioned on each side of the order workstation so as to define a storage area between the pair of display sections and workstation, at least one of the display sections is movable so as to allow access to the storage area; and a display tower disposed adjacent the shelf for highlighting a featured product or providing a product display area.

In accordance with another aspect of the present invention there is provided a combined photofinishing storage, display, and ordering merchandising unit, comprising:

an order workstation having a dispenser for dispensing order envelopes for ordering of photofinishing services, a writing surface for filling out of the order envelopes, and a collection bin for receiving filled order envelopes containing photographic materials;

a pair of display sections for displaying of photographic merchandise, one of said display sections is positioned on each side of the order workstation; and a display tower disposed adjacent the shelf.

In accordance with yet another aspect of the present invention there is provided a combined photofinishing display, and ordering merchandising unit, comprising:

an order workstation having a front wall having substantially S shaped configuration such that one end is forward of the other end, and a planar writing surface extending from the wall;

a pair of display sections for displaying of merchandise, one of the display sections being positioned on each side of the order workstation; and a display tower disposed adjacent the shelf and at the back end of the shelf so as provide a semi-private writing area.

DESCRIPTION OF THE DRAWINGS

Other objects, advantages and features of the present invention will become apparent from the following specification when taken in conjunction with the drawings in which like elements are commonly enumerated and in which.

DETAILED DESCRIPTION OF THE INVENTION

Figure 1:
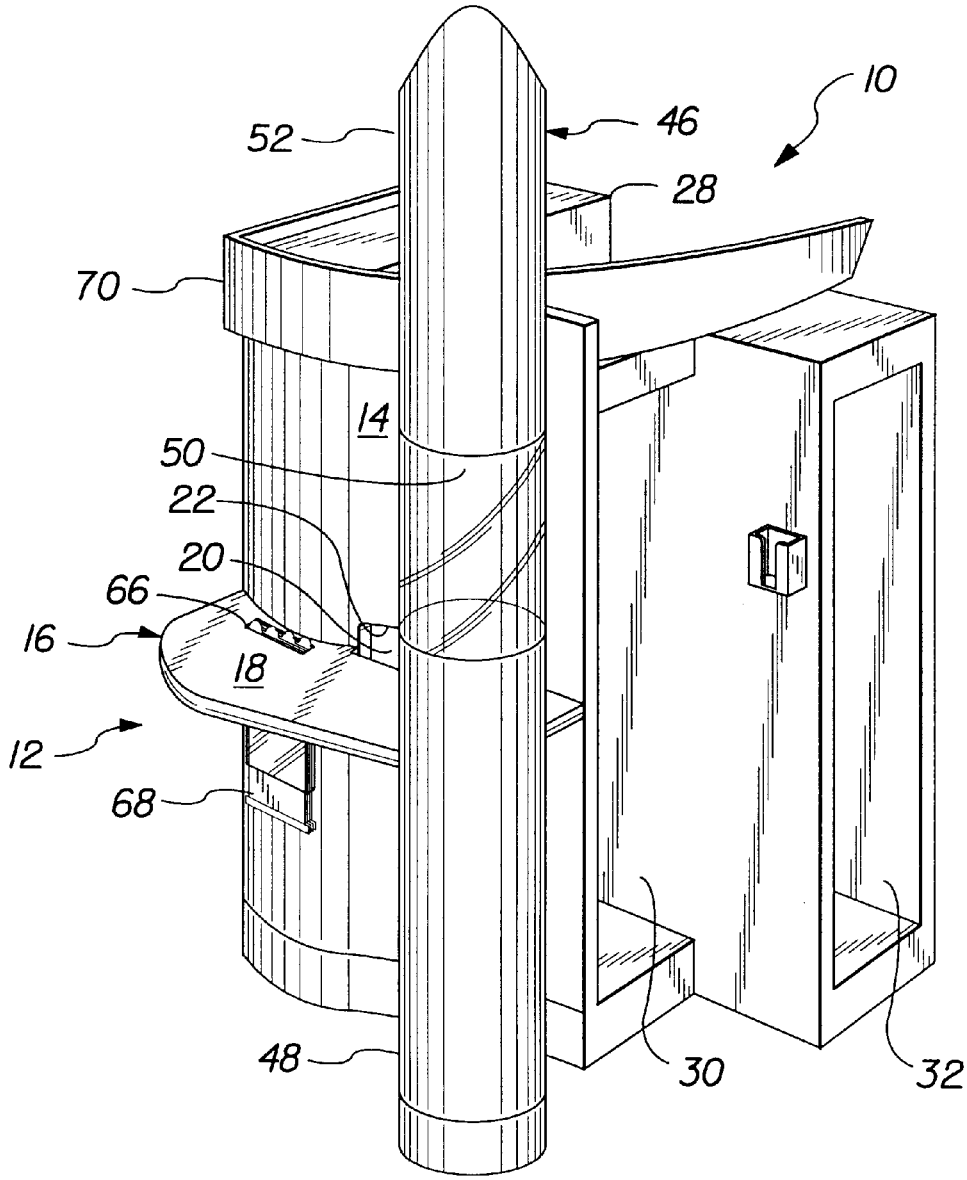
FIG. 1 is a perspective view of a merchandising unit made in accordance with the present invention.

Referring to FIGS. 1–5, there is illustrated a merchandising unit made in accordance with the present invention. In particular, merchandising unit 10 includes an order workstation 12 for use by a customer for ordering photofinishing services, such as ordering development of film and/or producing of photographic prints. The order workstation 12 includes a front wall 14 and work shelf 16 which extends from wall 14. The shelf 16 has a substantially planar writing surface 18 on which the customer may complete order envelopes. The workstation 12 further includes a dispenser 20 for dispensing of order envelopes (not shown). In the particular embodiment illustrated, order envelopes are designed to receive exposed rolls of photographic film. These envelopes are provided with spaces for providing customer order information, such as customer name, address, type of film to be developed, and type and number of prints desired. The envelopes may also include any other information desired. The order envelopes are dispensed from dispenser 20 through an opening 22 provided in the front wall 14 of the workstation 12. In the particular embodiment illustrated, the dispenser 20 is designed such that envelopes will be continuously biased against the opening 22 such that when an order envelope is removed through opening 22, the next envelope will be positioned at the opening 22 for use by the next customer.

A collection bin 24 is provided for accepting filled order envelopes. The collection bin 24 is periodically of emptied the order envelopes which are then forwarded to a photofinisher for processing and printing. In the particular embodiment illustrated, the collection bin 24 is accessed through an opening 26 provided in the front wall 14 of the order workstation 12. A flap 27 is provided along wall 14 to prevent inadvertent placement of item through opening 26 In the preferred embodiment illustrated, the writing surface 18 is disposed at an angle $\alpha$ with respect to the horizon (see FIG. 3) for ease of writing and minimizing the possibility of a customer leaving items thereon. If a customer leaves an item thereon unattended, the angled writing surface 18 will, in many instances, cause the item to slide along the writing surface 18 and potentially fall to the ground, thereby alerting the customer to take the item.

Display sections 28,30,32 are provided for displaying of product merchandise. In the particular embodiment illustrated, display section 28 is provided on one lateral side of the workstation 12 and display sections 30,32 are provided on the opposed lateral side of the workstation 12 such that a storage area 34 is defined by the order workstation 12 and sections 28,30,32. The storage area 34 may be used to store inventory or any other desired item. In the embodiment illustrated, the display section 32 extends outwardly from display module 30 so as to define a width W for the merchandising unit 10.

Figure 2A:
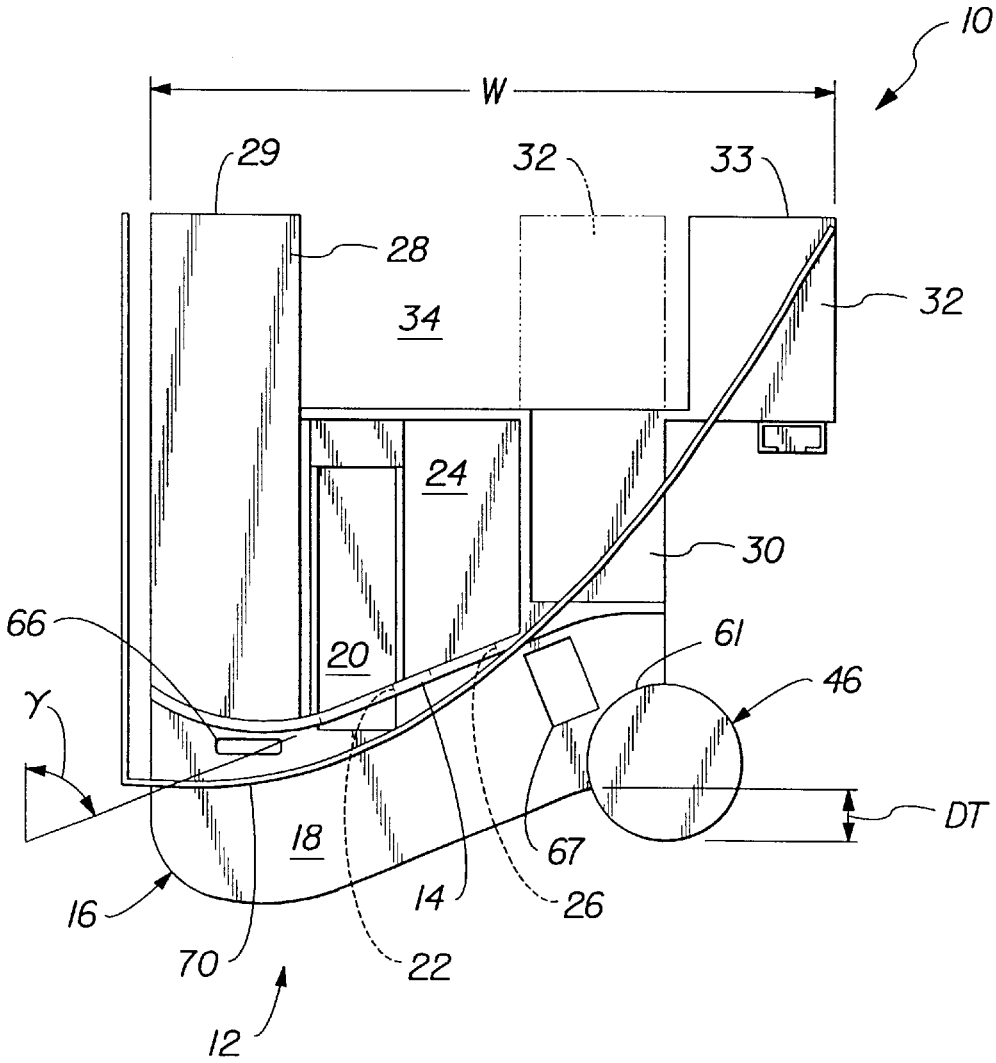
FIG. 2A is a top plan view of the display unit of FIG. 1.
Figure 2B:
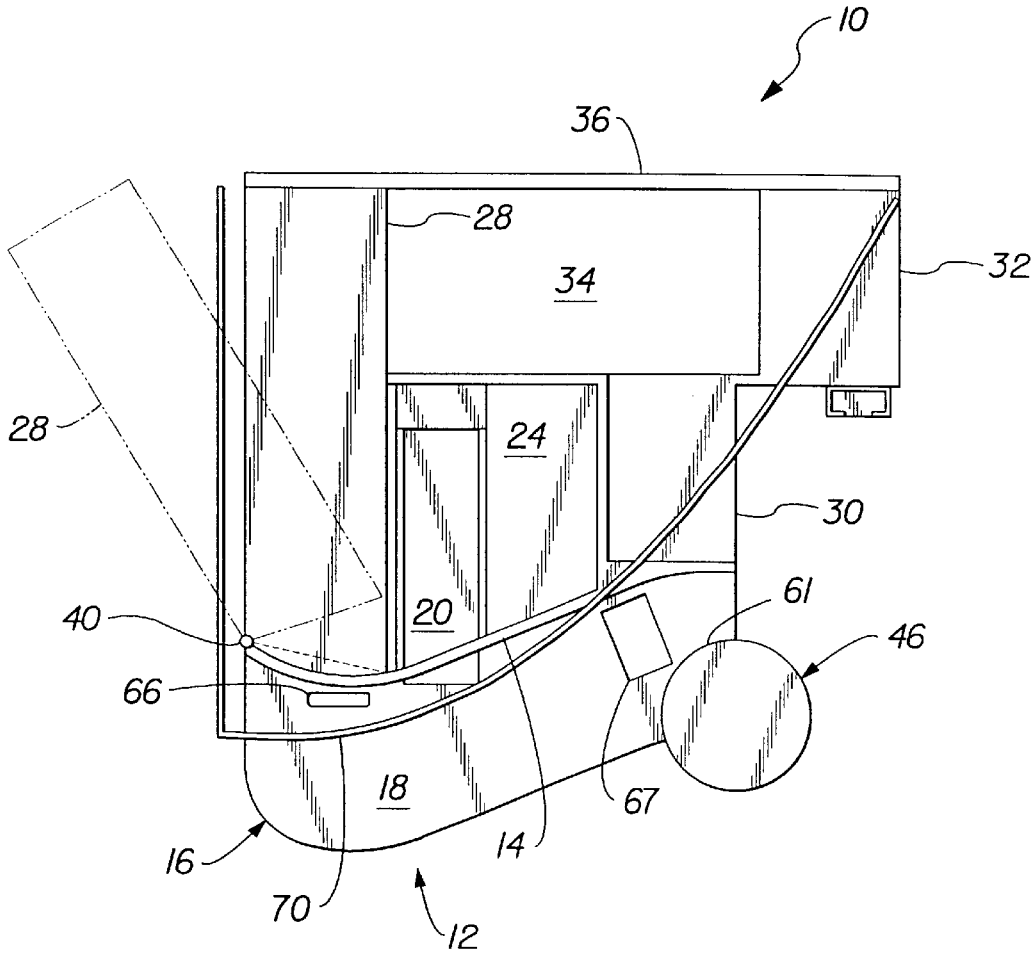
FIG. 2B is a view similar to FIG. 2A showing one of the display sections in the open position.
Figure 3:
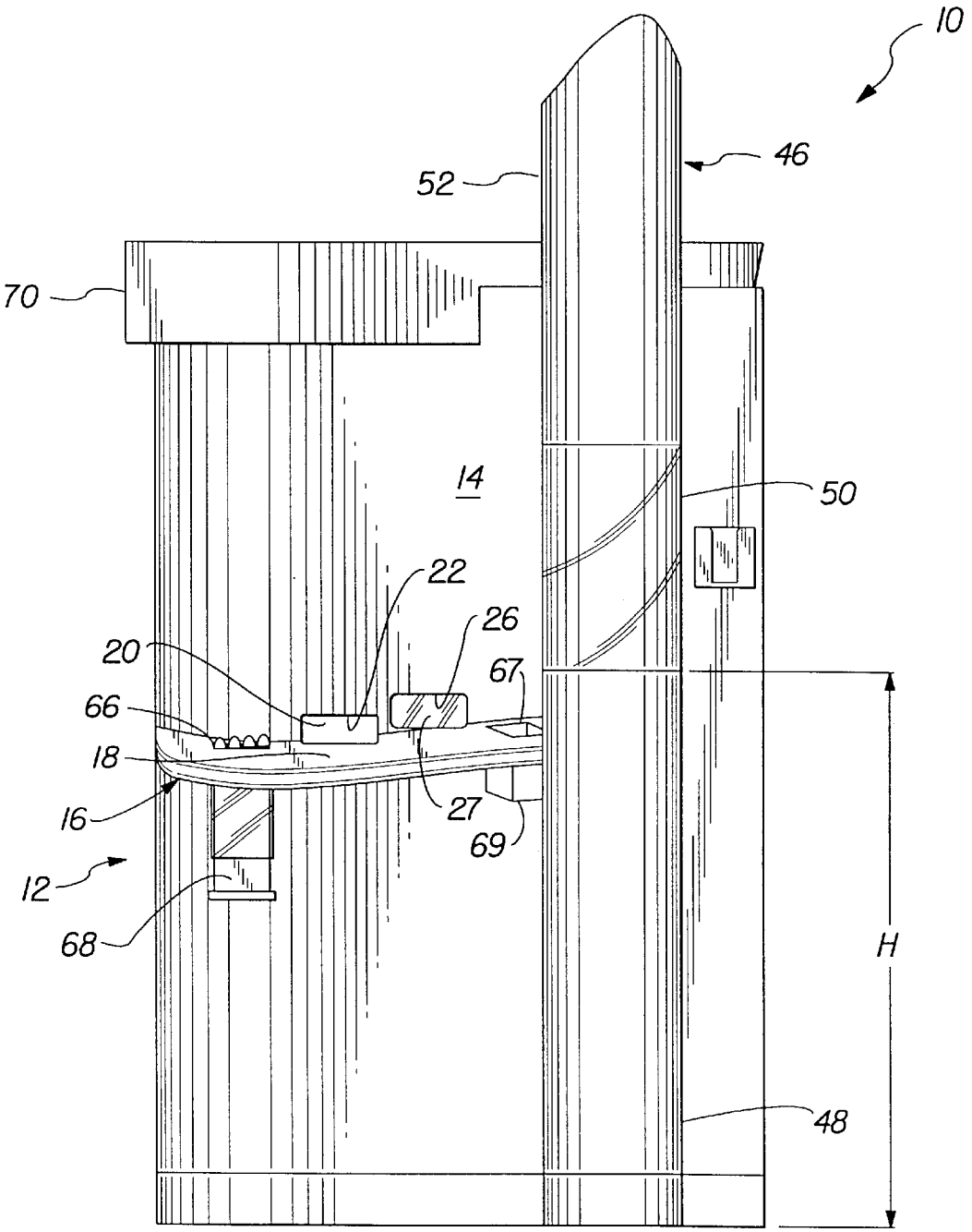
FIG. 3 is a front elevational view of the merchandising unit of FIG. 1.
Figure 4:
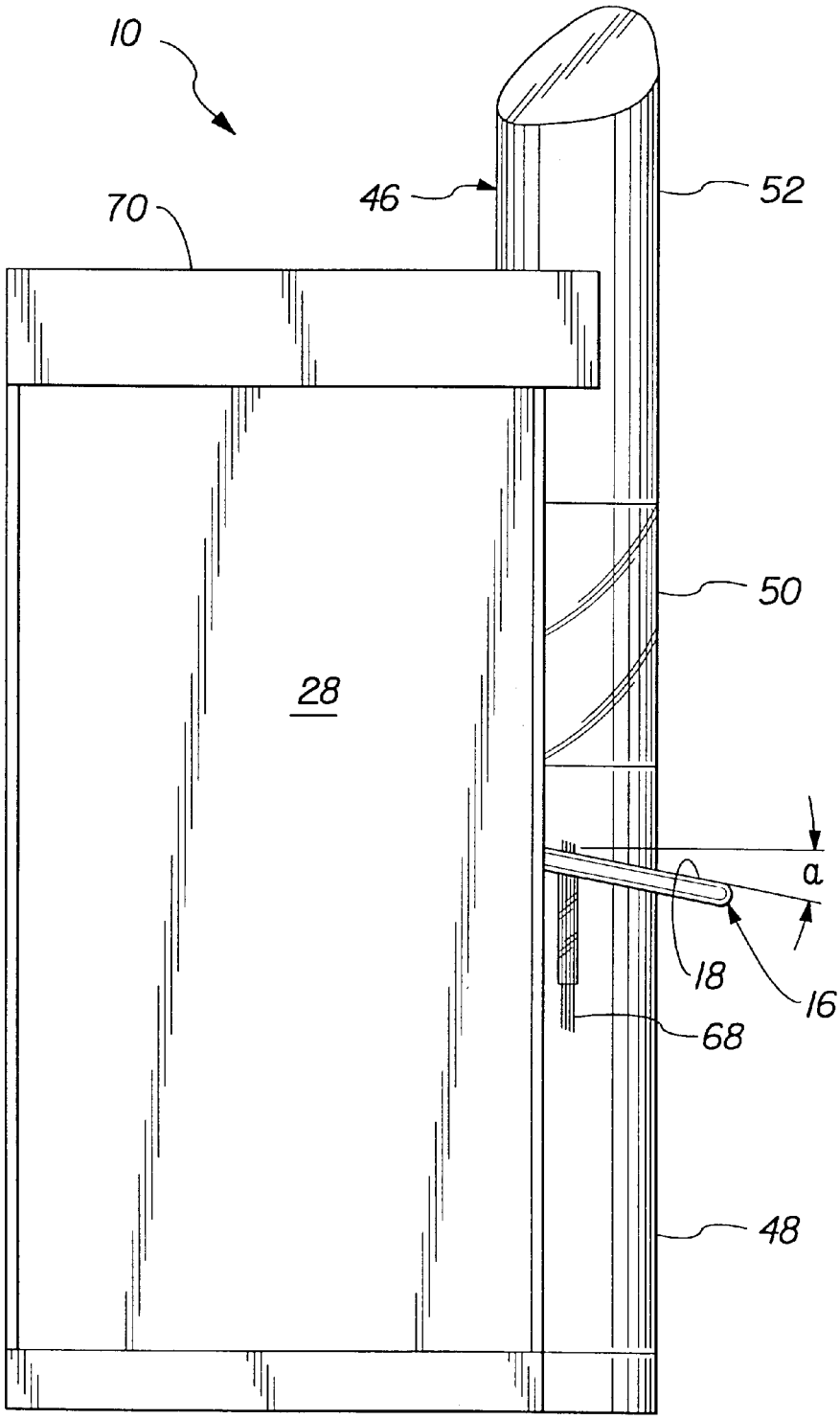
FIG. 4 is a side elevational view of the merchandising unit of FIG. 1 as taken along line 4—4 of FIG. 2.
Figure 5:
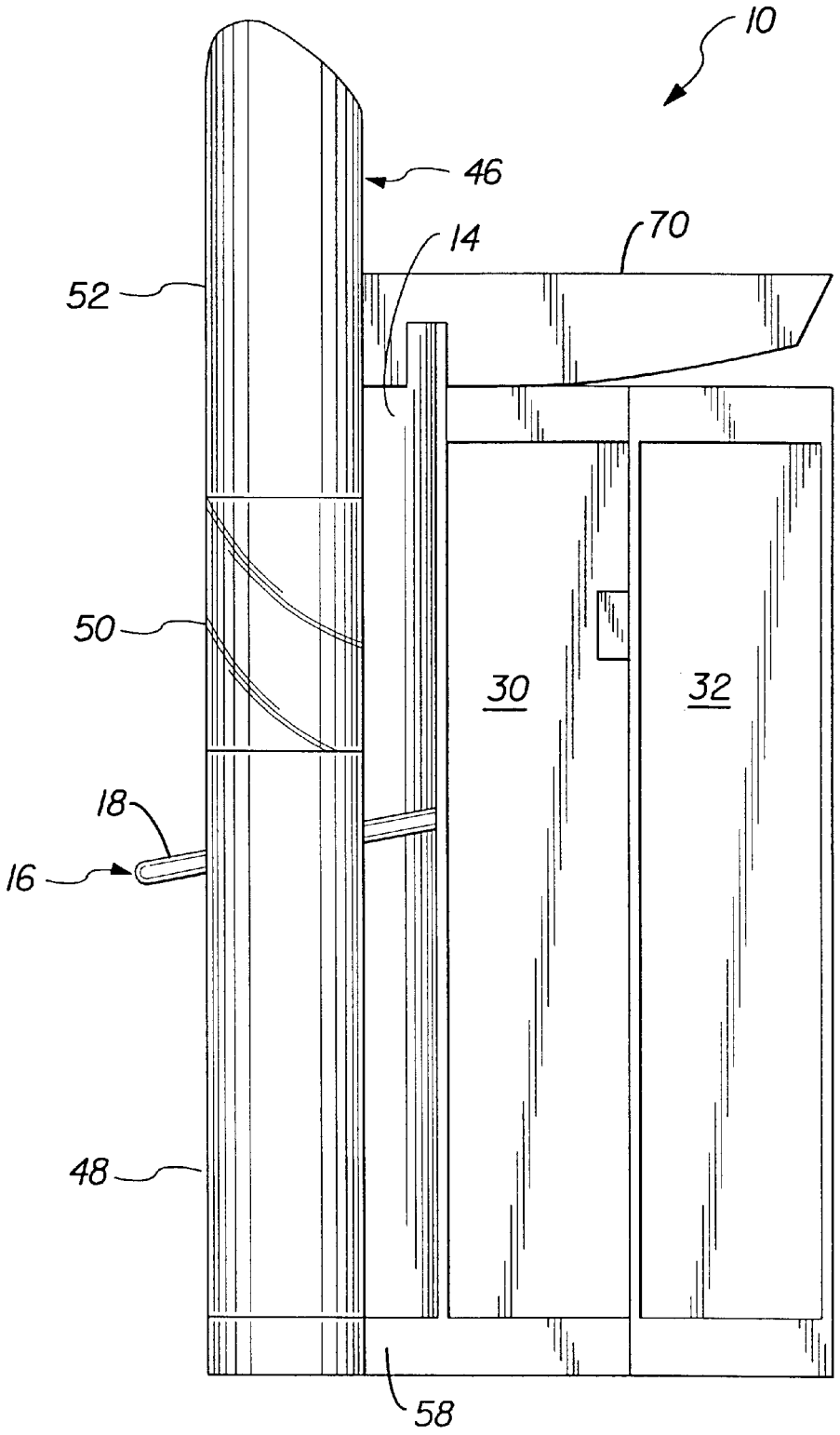
FIG. 5 is a side view of the merchandising unit of FIG. 1 as taken along line 5—5 of FIG. 2.

In the embodiment illustrated, the back surfaces 29,33 of display sections 28,32 are in co-alignment and are designed to back up to other products, display unit, and/or a display aisle. However, the merchandising unit may be designed as a free-standing unit in which case a back wall 36 would be provided as illustrated in FIG. 2B.

Preferably, one of the display sections 28,30,32 is designed to allow access to the storage area 34. In the particular, the display section 28 is movably secured to order workstation 12. In the embodiment illustrated display section 28 rotates about hinges 40 to swing open, much like a door, for allowing access to storage area 34 as illustrated in FIG. 2B. Alternately, the display section 28 or 32 may be slideably mounted for movement with respect to workstation 12 for allowing access to storage area 34. The moveable display section provides a relatively secure means for storing of inventory that is not seen by the customer, nor is readily accessible to the customer. It also places the inventory close to the point of sale, thereby making it easier and quicker to restock the display sections.

Display section 30 may be slideably mounted to provide for a width adjustment so that the unit 10 can be used in a variety of width spaces ranging from about 36" to about 48" wide back walls or aisle ends. The dash lines in FIG. 2A illustrates the innermost position of display section 30.

In the preferred embodiment illustrated, the front wall 14 and shelf 16 are curved backwards such that the writing surface 18 is angled backward at an overall angle $\gamma$ with respect to a line L parallel to the direction of the aisle (see FIG. 2). In the embodiment illustrated the writing surface 18 has a generally elongated "S" configuration. Since the writing surface 18 is substantially planar, the "S" shaped configuration provides a variable height writing surface 18 depending where you stand. Thus, a customer can use the area of the writing surface 18 which is most comfortable.

A display tower 46 is disposed adjacent the shelf 16, preferably at the rear end of shelf 16. The display tower 46 comprises a base section 48, a display case 50, and a cap 52. In the embodiment illustrated the base section 48, case 50, and cap 52 each have a cylindrical shape, however, these parts may have any other shape desired. The cap 52 preferably extends above the remaining part of the workstation 10 so to provide a beacon for catching the eye of potential consumers. The tower 46 is preferably spaced from wall 12, such that it extends a distance DT past the front of shelf 16 and located at the rear of the "S" shaped shelf 16. The positioning of the tower 46 at the back end of the writing surface 14 provides a semi-private writing area in which a customer may stand for filling of order envelopes. The distance DT is preferably equal to about the width of an average individual.

Figure 6:
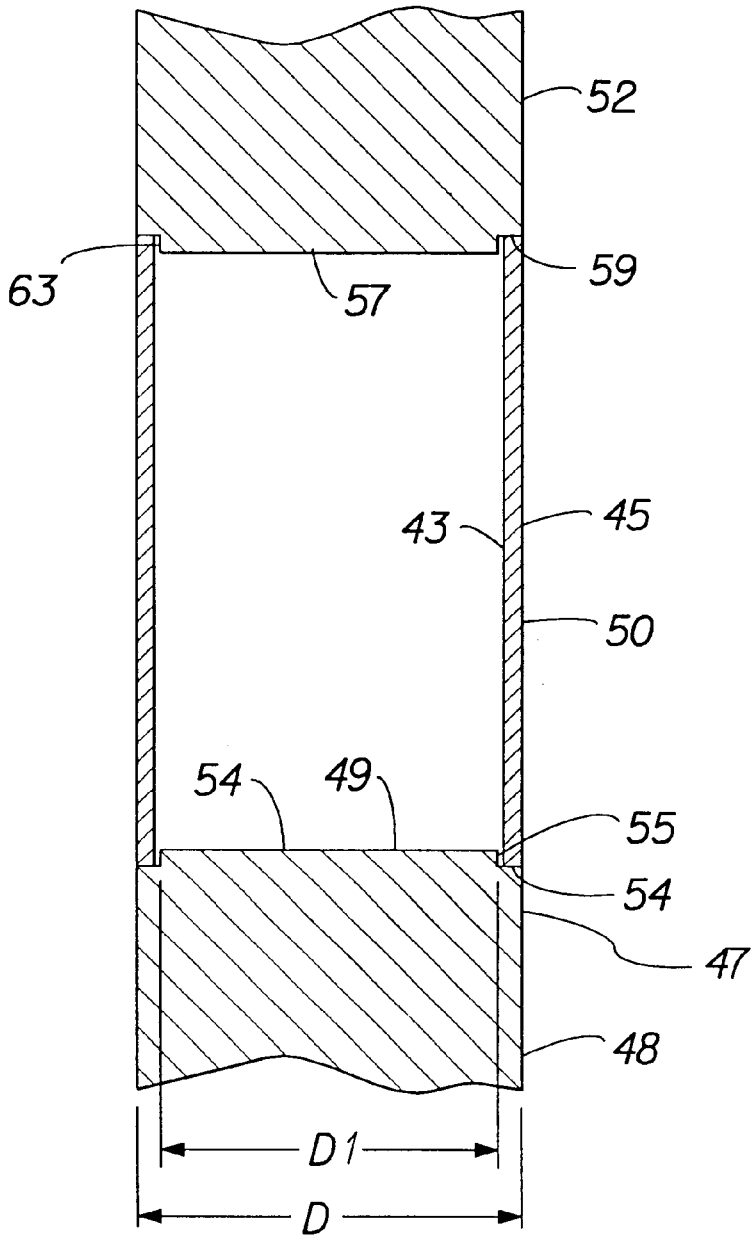
FIG. 6 is and enlarged cross-section view of a portion of the display tower as taken a long 6—6 of FIG. 5.

Referring to FIG. 6 there is illustrated an enlarged cross-sectional view of the case 50 and a portion of the base section 48 and cap 52. The display case 50 in this embodiment is designed to be slideably mounted to the base section 48 and cap 50. In particular, the case 50 comprises a cylindrical shell having an inner cylindrical surface 43 and outer cylindrical surface 45. The upper end 47 of base section 48 has an inner cylindrical projection 49 which forms a support surface 54 for supporting display case 50. The projection 49 has a diameter D1 which is less than diameter D of base section 48 such that an annular outer support ledge is provided for supporting case 50. The outer surface 55 of projection 49 mates with the inner surface 43 of case 50. The cap 52 also has an inner cylindrical projection 57 which also has a diameter D1 and form an annular ledge 59 for engagement with the upper end 61 of case 50. The outer surface 63 of projection 57 also mates with the inner surface 43 of case 50. In this way, the base section 48, display case 50, and cap 52 can be easily assembled and/or disassembled.

In order to provide a stable display tower 48, a connecting base section 58 (see FIG. 5), which has one end connected to wall 14, is provided having an opening 60 at the other end for retaining the bottom of base section 48. The area 61 of the base section 48 adjacent the shelf 16 is preferably secured to the shelf in any convenient manner.

In the preferred embodiment illustrated in FIGS. 1–7, the display case 50 has a substantially cylindrical shape and is made out of a material which allows viewing of items within the display case 50 in 360°. In the embodiment illustrated, the case 50 is made of a clear plastic material. In display case 50, a featured product may be placed directly on support surface 54, or may be suspended in some manner from the cap 52. The base section 50 has a height H such that display case 50 is provided at substantially eye level of the customer. As can be seen, display case 48 provides a relatively secure area to display a featured product without customers being able to directly handle or touch the featured product. This allows for the placement of products in the unpackaged state for display. This also allows for protection of the featured product, such that it will retain its pristine appearance and condition for long periods of time. A light (not shown) may be provided in the cap 52 or base section 48 for highlighting of the featured product within the display case 50. Optional locking means may also be provided for locking cap 52, base 48, and case 50, thereby further increasing the security of any featured product placed within the case.

In the embodiment illustrated a protective display case 50 is provided for display a featured item. However, in place of the protective case 50, the case may replace by a display section products that can be purchased by the customer.

The shelf 16 also includes a slot 66 for retaining a series of cards for providing detailed information to the consumer regarding use of the workstation 12. The cards are preferably provide with tabs which extend past the ends of the slot 66 at the upper and lower ends so that the cards will be retained with the slot 66 but also allows movement of the cards for reading of the cards. The pull-out card system provides more information to the customer, but takes up little additional space.

The shelf 16, in the embodiment illustrated includes a second slot 67 and a retaining basket 69 disposed below the slot 67 for supporting informational literature, for example advertising and sales brochures, that can be taken by the customer. The basket 69 can be secured to the shelf 16 or front wall 12 in any desired manner. This also allows additional information to be provided to the consumer while taking up little product display area.

The merchandising unit 10 in the embodiment illustrated is provided with an header 70 that extends around the display sections 28,30,32 and front wall 14 so as to provide unifying appearance.

Figure 7:
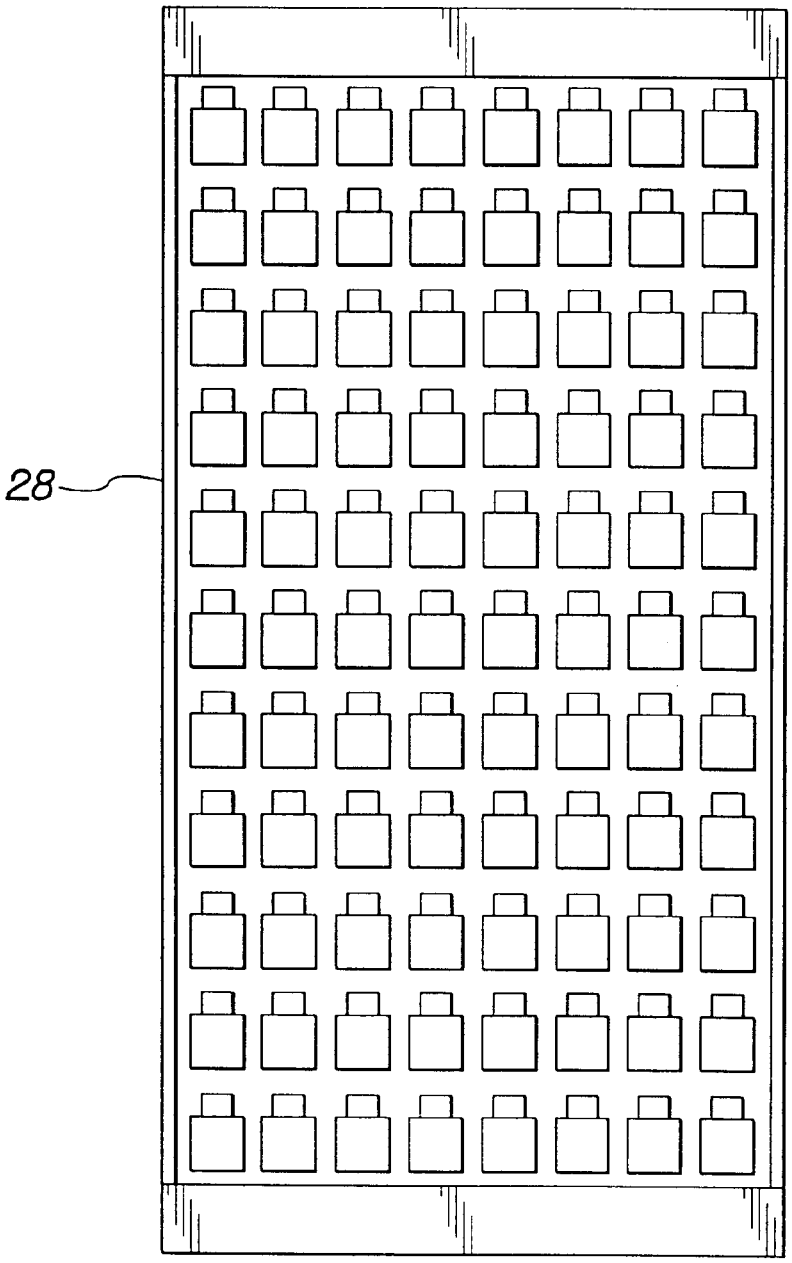
FIG. 7 is an elevation view of the display section illustrated in FIG. 4 with products for sale placed therein.
Figure 8:
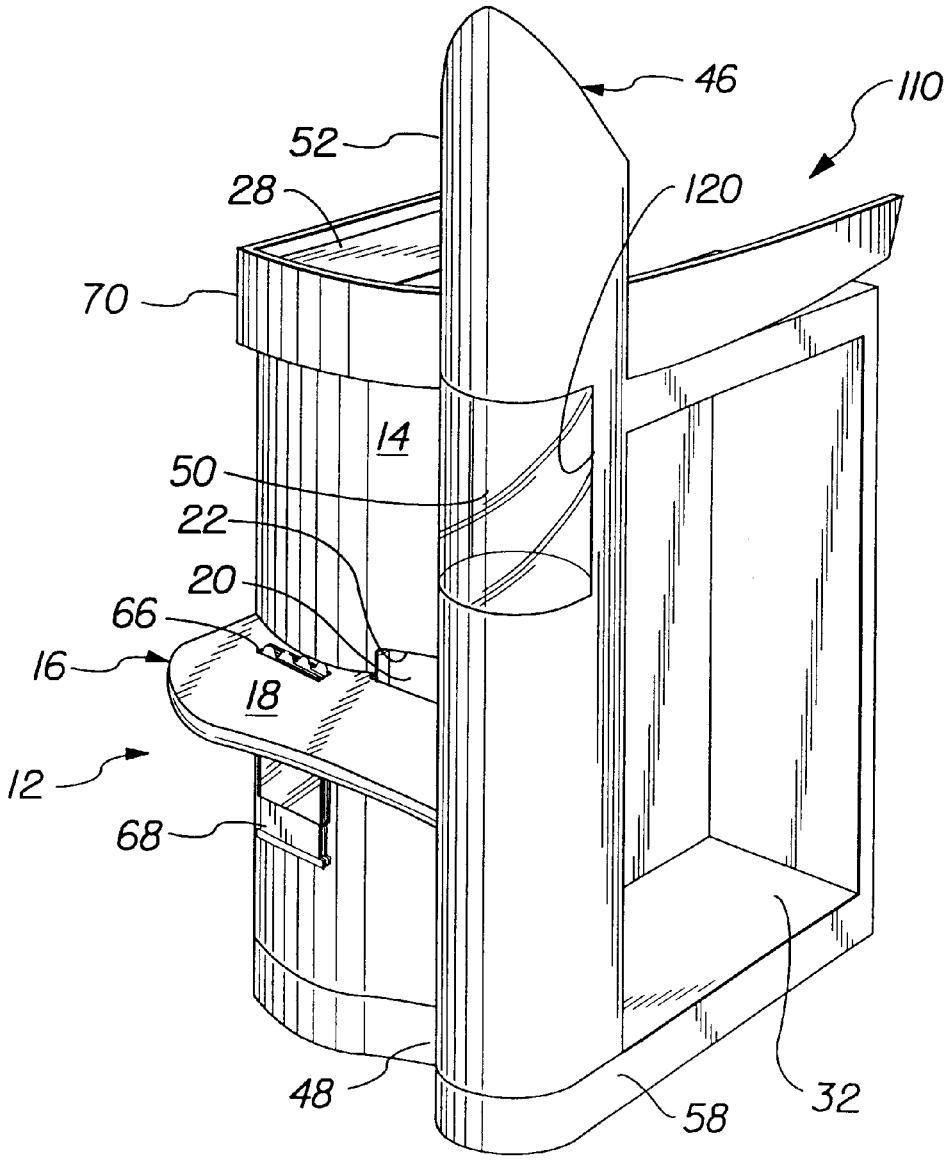
FIG. 8 is a perspective view of a modified merchandising unit made in accordance with the present invention.
Figure 9:
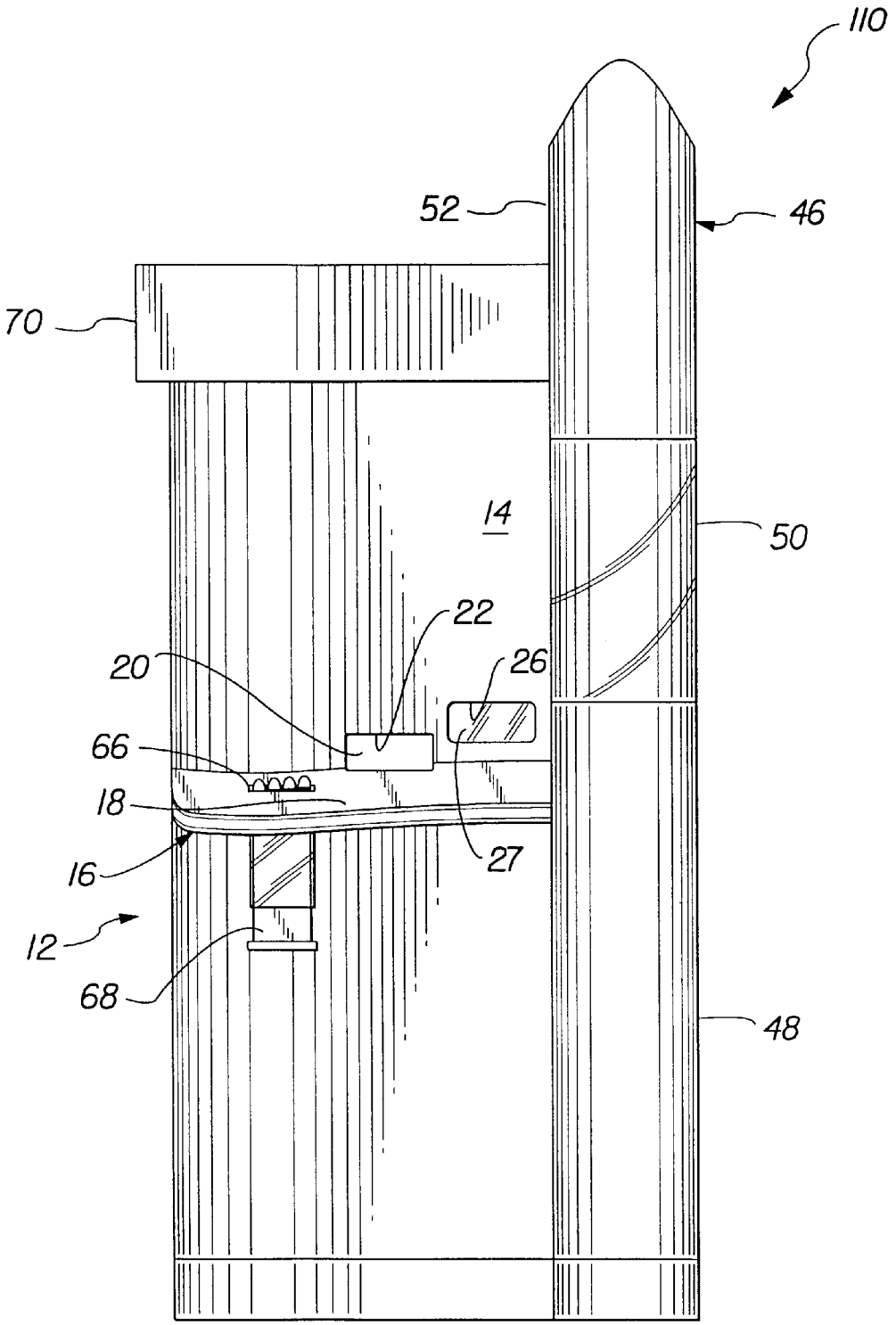
FIG. 9 is a front elevation view of merchandising unit of FIG. 8.
Figure 10:
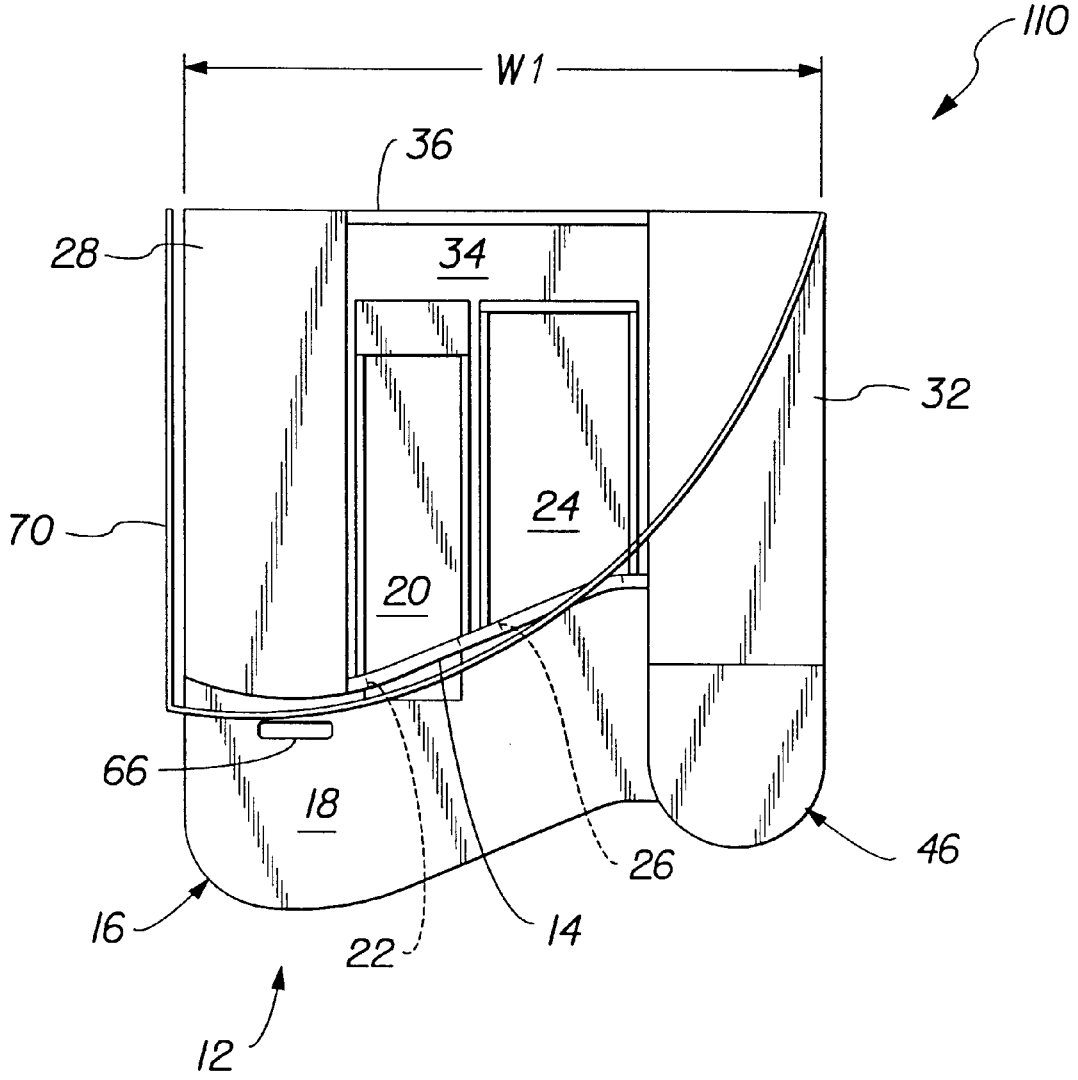
FIG. 10 is a top plan view of the merchandising unit of FIG. 8.
Figure 11:
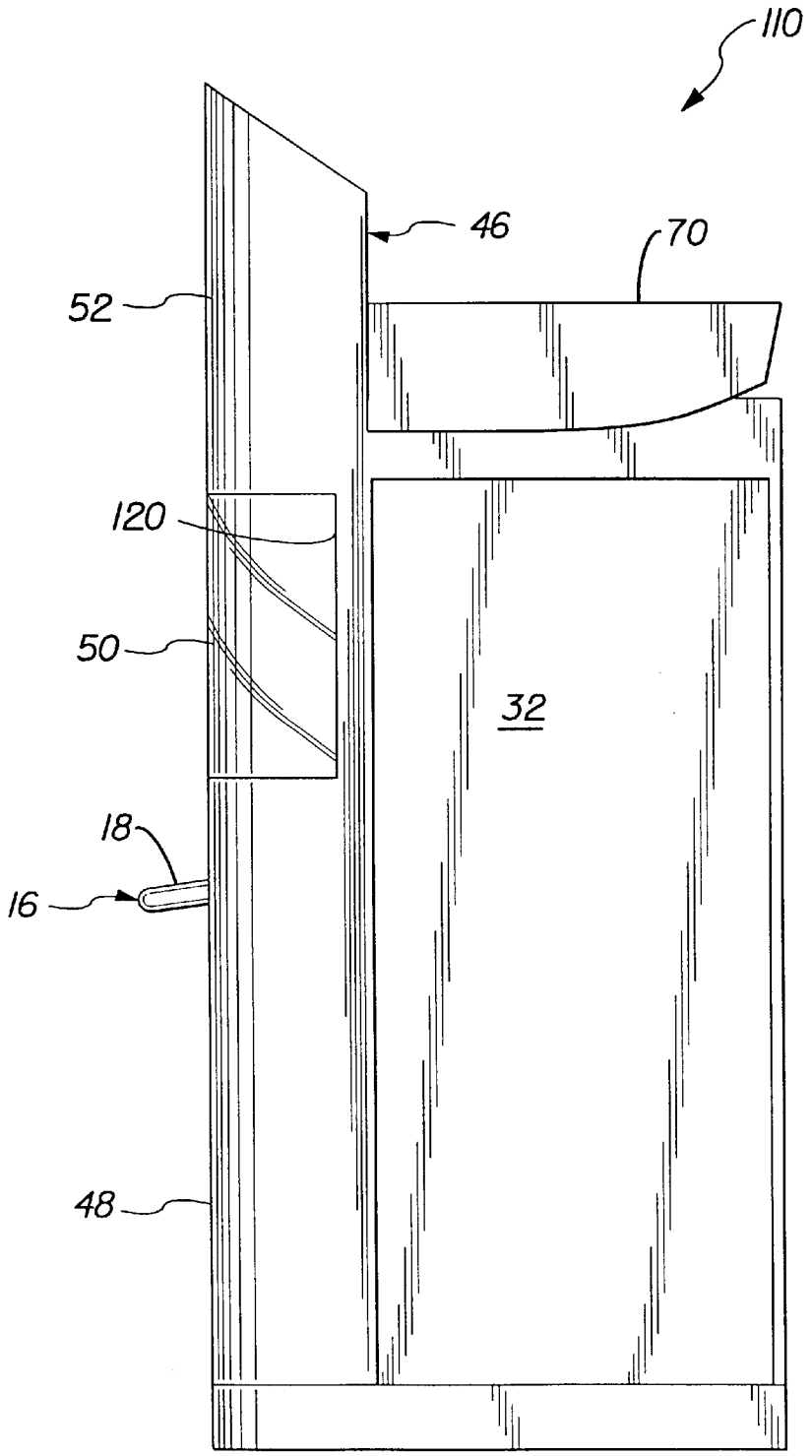
FIG. 11 is a side elevational view of the merchandising unit of FIG. 10 as taken along line 11—11.
Figure 12:
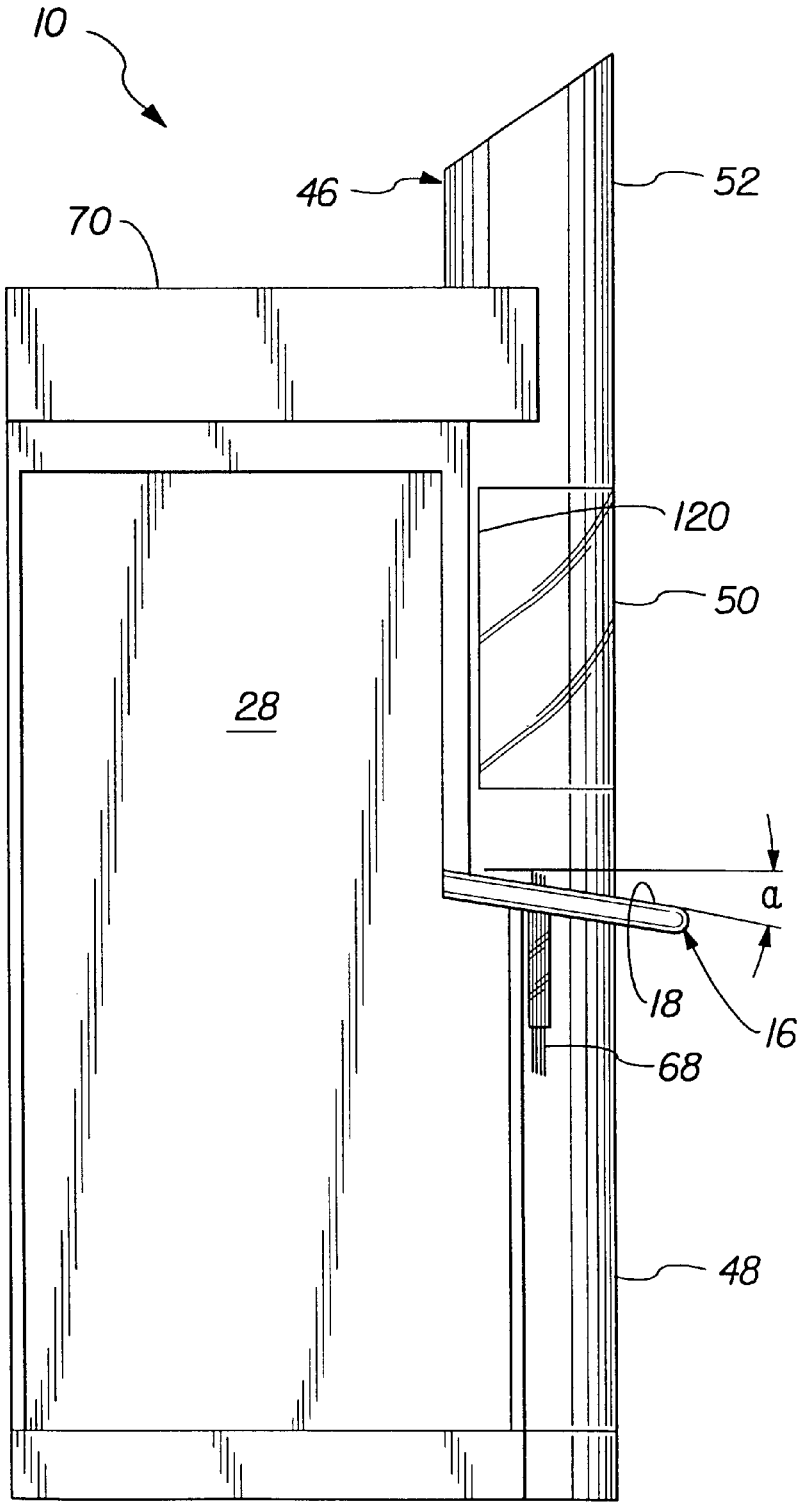
FIG. 12 is a side elevational view of the merchandising unit of FIG. 10 as taken along line 12—12.

Referring to FIG. 7, there is illustrated a front elevational view of display section 28. As can be seen, a plurality of products, such as film packages, cameras, and other associated photographic products are displayed. Quite often while the customer is filling out photofinishing order envelopes, there is a need for the customer to obtain unexposed film for future. The combining of the display sections with the order entry station provides a reminder to the customer to purchase such items and also makes it convenient for the customer to do so.

Thus, it can be seen that the present invention provides a combined storage display, and ordering merchandising unit which provides a convenient way for filling out photofinishing orders while also providing some degree of privacy for the customer. In addition, the display case is provided adjacent the customer for showcasing of featured products for the customer as the customer fills out their order envelope.

Various modifications can be made to the merchandising unit. For example, referring to FIGS. 8–12, there is illustrated a modified merchandising unit 110 made in accordance with the present invention, like numerals indicating like parts and operation as previously described. In this embodiment, the unit 10 is narrower in width. In particular, the unit has a width W1 which is less than the width W of unit 10. The display section 32 has been moved into the unit providing a smaller storage space 34. Additionally in this embodiment, the display tower 46 is integrally shaped with wall 12. The display tower 46 has a substantially "D" shaped configuration with the straight side of the tower being secured to the wall 12. This does not have the full 360 view capability of the previous embodiment. However, in this embodiment the case 50 is designed to simply slide into and out of a recess 120 provided in tower 46.

It is to be understood that various other changes and modifications may be made without departing from the scope of the present invention. The present invention being defined by the claims set forth hereinafter.

Parts List

10 merchandising unit
12 order workstation
14 front wall
16 work shelf
18 planar writing surface
20 dispenser
22,26 opening
24 collection bin
27 flap
28,30,32 display sections
29,33 back surfaces
34 storage area
36 back wall
40 hinges
43 inner cylindrical surface
45 outer cylindrical surface
46 display tower
47 upper end
48 base section
49 projection
50 display case
52 cap
54 support surface
55 outer surface
57 inner cylindrical projection
58 base section
59 annular ledge
60 opening
61 upper end
63 outer surface
66,67 slot
69 basket
70 header
110 modified merchandising unit
120 recess

What is claimed is:

1. A combined photofinishing storage, display, and ordering merchandising unit, comprising:

an order workstation having a front wall, a writing surface extending from said wall, a dispenser for dispensing order envelopes, and a collection bin for receiving filled order envelopes;

a pair of display sections for displaying of merchandise, one of said display sections being positioned on each side of said order workstation so as to define a storage area between said pair of display sections and workstation, at least one of said display sections being movable so as to allow access to said storage area; and a display tower disposed adjacent said writing surface for highlighting a featured product.

2. A merchandising unit according to claim 1 wherein said writing surface is curved and said tower is positioned adjacent said shelf so as to provide a privacy area for a customer to fill said order envelopes.

3. A merchandising unit according to claim 2 wherein said writing surface is disposed at an angle with respect to the horizon such that the writing surface has a varying height.

4. A merchandising unit according to claim 1 wherein said display tower comprises a base portion and a case section which is slideably mounted to said base portion, said case section and base portion forming a display section for displaying a featured product or products.

5. A merchandising unit according to claim 4 wherein a cap section is provided on top of said display section.

6. A merchandising unit according to claim 4 wherein case section is fully enclosed so as to provide a secure display area, said display section having a portion which is constructed for allowing viewing of a product displayed therein.

7. A merchandising unit according to claim 6 where said base portion and case section are substantially cylindrical in shape and are slideably mounted to each other.

8. A merchandising unit according to claim 7 wherein said display section is substantially cylindrical in shape and allows viewing in substantially 360°.

9. A merchandising unit according to claim 6 wherein locking means are provided for securing of said display section.

10. A merchandising unit according to claim 6 wherein said merchandising unit further comprising a light for highlighting products in said display section.

11. A merchandising unit according to claim 1 wherein said movable display section is pivotally mounted to said order workstation.

12. A merchandising unit according to claim 1 wherein said movable display section is slideably mounted to said order workstation.

13. A merchandising unit according to claim 1 wherein said dispenser allowing dispensing of envelopes one at a time.

14. A merchandising unit according to claim 1 wherein said merchandising unit further comprises a slot for receiving cards having information thereon for use by consumer at said order workstation.

15. A merchandising unit according to claim 1 wherein one of the display sections is slideably mounted for adjusting the width of said merchandising unit.

16. A combined photofinishing storage, display, and ordering merchandising unit, comprising:

an order workstation having a dispenser for dispensing order envelopes for ordering of photofinishing services, a writing surface for filling out of said order envelopes, and a collection bin for receiving filled order envelopes containing photographic materials;

a pair of display sections for displaying of photographic merchandise, one of said display sections being positioned on each side of said order workstation; and a display tower disposed adjacent said writing surface, said writing surface is curved and said tower is positioned adjacent said shelf so as to provide a privacy area for a customer to fill said order envelopes.

17. A merchandising unit according to claim 16 wherein said display tower comprises a base portion and a case section which is slideably mounted to said base portion, said case section and base portion forming a display section for displaying a featured product or products.

18. A merchandising unit according to claim 17 wherein case section is fully enclosed so as to provide a secure display area, said display section having a portion which is constructed for allowing viewing of a product displayed therein.

19. A merchandising unit according to claim 17 where said base portion and case section are substantially cylindrical in shape and are slideably mounted to each other.

20. A merchandising unit according to claim 17 wherein said case section is substantially cylindrical in shape and allows viewing in substantially 360°.

21. A merchandising unit according to claim 17 wherein locking means are provided for securing of said case section.

22. A merchandising unit according to claim 17 wherein a cap section is provided on top of said display section.

23. A merchandising unit according to claim 17 wherein said merchandising unit further comprising a light for highlighting products in said display section.

24. A merchandising unit according to claim 16 wherein one of said display sections is movable with respect said order workstation.

25. A merchandising unit according to claim 16 wherein one of said display sections is slideably mounted to said order workstation.

26. A merchandising unit according to claim 16 wherein said dispenser allowing dispensing of envelopes one at a time.

27. A merchandising unit according to claim 16 wherein said merchandising unit further comprises a slot for receiving cards having information thereon for use by consumer at said order workstation.

28. A combined photofinishing storage, display, and ordering merchandising unit, comprising:

an order workstation having a front wall having a substantially S shaped configuration such that one end is forward of the other end, and a planar writing surface extending from said wall;

a pair of display sections for displaying of merchandise, one of said display sections being positioned on each side of said order workstation; and a display tower disposed adjacent said writing surface and at the back end of said writing surface so as provide a semi-private writing area.

29. A merchandising unit according to claim 28 wherein said display tower extend outward from said writing surface providing an area in which an individual may stand.

30. A merchandising unit according to claim 29 where said tower comprising a base portion and a case section, said case section being slidably mounted to said base portion.

31. A merchandising unit according to claim 28 wherein one of the display sections is slideably mounted for adjusting the width of said merchandising unit.

* * * * *